US011806765B2

(12) United States Patent
Fike

(10) Patent No.: US 11,806,765 B2
(45) Date of Patent: Nov. 7, 2023

(54) SUCKER ROD CLEANING USING INDUCTIVE HEATING

(71) Applicant: Baranko Environmental LLC, Dickinson, ND (US)

(72) Inventor: Darren K. Fike, Dickinson, ND (US)

(73) Assignee: Baranko Environmental LLC, Dickinson, ND (US)

( * ) Notice: Subject to any disclaimer, the term of this patent is extended or adjusted under 35 U.S.C. 154(b) by 0 days.

(21) Appl. No.: 17/993,209

(22) Filed: Nov. 23, 2022

(65) Prior Publication Data

US 2023/0126572 A1 Apr. 27, 2023

Related U.S. Application Data

(63) Continuation of application No. 16/908,892, filed on Jun. 23, 2020, now Pat. No. 11,524,320.
(Continued)

(51) Int. Cl.
*B08B 7/00* (2006.01)
*B08B 5/02* (2006.01)
(Continued)

(52) U.S. Cl.
CPC ..... *B08B 7/0035* (2013.01); *B08B 5/023* (2013.01); *B08B 13/00* (2013.01); *E21B 17/1071* (2013.01); *E21B 37/00* (2013.01)

(58) Field of Classification Search
CPC ..... B08B 13/00; B08B 5/023; B08B 7/0035; B08B 7/0071; B08B 7/02; E21B 17/1071; E21B 37/00; E21B 43/127; F04B 47/026
See application file for complete search history.

(56) References Cited

U.S. PATENT DOCUMENTS 1,840,334 A 1/1932 Schuster
2,647,200 A 7/1953 Redmond
(Continued)

FOREIGN PATENT DOCUMENTS

CN 103276185 B 8/2014
EP 1375680 A1 1/2004

OTHER PUBLICATIONS

Prosecution history from corresponding U.S. Appl. No. 16/908,892, filed Jun. 23, 2020 including: Notice of Allowance and Fee(s) Due dated Aug. 11, 2022, Non-Final Rejection dated Mar. 17, 2022, and Non-Final Rejection dated Sep. 29, 2021.
(Continued)

*Primary Examiner* — Duy Vu N Deo
*Assistant Examiner* — Christopher Remavege
(74) *Attorney, Agent, or Firm* — Brian D. Kaul; Westman, Champlin & Koehler, P.A.

(57) ABSTRACT

A sucker rod cleaning system includes an inductive heating device, a feed mechanism, a first support and a second support. An electromagnet of inductive heating device includes a wire coil head that is configured to inductively heat a sucker rod positioned within a heating zone. The feed mechanism is configured to feed a sucker rod through the heating zone in a feed direction. The first support is positioned on an upstream side of the wire coil head, and is configured to support a portion of a sucker rod as it is fed through the heating zone by the teed mechanism. The second support is positioned on a downstream side of the wire coil head, and is configured to support a portion of a sucker rod as it is fed through the heating zone by the feed mechanism.

20 Claims, 5 Drawing Sheets

Related U.S. Application Data

(60) Provisional application No. 62/872,753, filed on Jul. 11, 2019.

(51) Int. Cl.

| | |
|---|---|
| ***B08B 13/00*** | (2006.01) |
| ***E21B 17/10*** | (2006.01) |
| ***E21B 37/00*** | (2006.01) |

(56) References Cited

U.S. PATENT DOCUMENTS

| | | | |
|---|---|---|---|
| 3,958,049 | A | 5/1976 | Payne |
| 4,045,591 | A | 8/1977 | Payne |
| 4,307,276 | A | 12/1981 | Kurata et al. |
| 4,418,259 | A | 11/1983 | Lewis |
| 4,420,667 | A | 12/1983 | Lewis |
| 4,433,226 | A | 2/1984 | Wagar |
| 4,442,331 | A | 4/1984 | Watanabe |
| 4,468,261 | A | 8/1984 | Woodings |
| 4,482,793 | A | 11/1984 | Lewis |
| 4,494,607 | A | 1/1985 | Ford et al. |
| 4,501,942 | A | 2/1985 | Lewis |
| 4,877,386 | A | 10/1989 | Hinds et al. |
| 5,217,069 | A | 6/1993 | Badon |
| 6,455,825 | B1 | 9/2002 | Bentley et al. |
| 7,985,938 | B2 | 7/2011 | Johnson |
| 8,900,372 | B2 | 12/2014 | White |
| 8,920,570 | B2 | 12/2014 | White |
| 9,167,632 | B2 | 10/2015 | Weiss et al. |
| 9,278,412 | B2 | 3/2016 | Johnson et al. |
| 9,840,893 | B2 | 12/2017 | Johnson |
| 9,869,135 | B1 | 1/2018 | Martin |
| 10,195,699 | B2 | 2/2019 | Johnson et al. |
| 11,510,290 | B2 * | 11/2022 | Beistle ..... H05B 6/06 |
| 11,524,320 | B2 * | 12/2022 | Fike ..... B08B 7/0071 |
| 2008/0149622 | A1 | 6/2008 | Weiss et al. |
| 2008/0197168 | A1 * | 8/2008 | Horino ..... B08B 7/0035 228/8 |
| 2011/0036138 | A1 * | 2/2011 | Dial ..... B21J 5/08 72/342.94 |
| 2012/0305234 | A1 | 12/2012 | Vowels |
| 2013/0153303 | A1 | 6/2013 | Angelle et al. |
| 2013/0192682 | A1 | 8/2013 | Freese |
| 2013/0316173 | A1 | 11/2013 | Moore et al. |
| 2014/0053404 | A1 | 2/2014 | Johnson et al. |
| 2014/0124001 | A1 | 5/2014 | White |
| 2016/0151819 | A1 | 6/2016 | Johnson et al. |
| 2019/0169706 | A1 | 6/2019 | Liu et al. |
| 2019/0211633 | A1 * | 7/2019 | Badrak ..... F16L 9/02 |
| 2021/0008607 | A1 | 1/2021 | Fike |
| 2021/0025247 | A1 | 1/2021 | Ford |

OTHER PUBLICATIONS

Liu Dan et al., CN103276185 B, Machine Translation produced by Espacenet.com (Year: 2022).

* cited by examiner

SUCKER ROD CLEANING USING INDUCTIVE HEATING

CROSS-REFERENCE TO RELATED APPLICATION

The present application is a continuation of U.S. Ser. No. 16/908,892, filed Jun. 23, 2020, which is based on and claims the benefit of U.S. provisional patent application Ser. No. 62/872,753, filed Jul. 11, 2019, the contents of each of which are hereby incorporated by reference in their entirety.

FIELD

Embodiments of the present disclosure generally relate to systems and methods for cleaning sucker rods and, more specifically, to sucker rod cleaning systems and methods utilizing an inductive heating device.

BACKGROUND

Oil and gas extraction and processing operations use sucker rods to join surface and downhole components of a reciprocating piston pump installed in an oil well. Sucker rods are rigid rods that typically extend between 25-30 feet in length. The sucker rods may be joined together to extend to a desired length, such as using couplings that attach to threaded ends of the sticker rods.

During use, sucker rods accumulate scale and deposits (hereinafter "scale"). This scale may include naturally occurring radioactive material at concentrations above normal in by-product waste streams. Because the extraction process concentrates the naturally occurring radionuclides and exposes them to the surface environment and human contact, these wastes are classified as Technologically Enhanced Naturally Occurring Radioactive Material (TENORM). The primary radionuclides of concern in oil and gas TENORM are radium-226 and radium-228. These isotopes are the decay products of uranium and thorium isotopes that are present in subsurface formations from which hydrocarbons are produced. The source for most oil and gas TENORM is dissolved radium that is transported to the surface in the produced water waste stream. The dissolved radium remains in solution in the produced water, coprecipitates with barium, strontium, or calcium to form a hard sulfate scale. These radioactive scale deposits lead to disposal problems when the equipment is taken off-line for repair or replacement.

It is desirable to remove the scale prior to reusing or disposing the sucker rods. Exemplary conventional techniques for cleaning sucker rods include scraping, brushing, applying chemical compounds, media blasting, and other processes.

SUMMARY

Embodiments of the present disclosure are directed to a sucker rod cleaning system and methods of cleaning sucker rods using the system. One embodiment of the system includes an inductive heating device, a feed mechanism, a first support and a second support. An electromagnet of the inductive heating device includes a wire coil head that is configured to inductively heat a sucker rod positioned within a heating zone. The feed mechanism is configured to feed a sucker rod through the heating zone in a feed direction. The first support is positioned on an upstream side of the wire coil head, and is configured to support a portion of a sucker rod as it is fed through the heating zone by the feed mechanism. The second support is positioned on a downstream side of the wire coil head, and is configured to support a portion of a sucker rod as it is fed through the heating zone by the feed mechanism.

In one embodiment of the method of cleaning a sucker rod, the sucker rod is fed in a teed direction through the wire coil head and the heating zone using the feed mechanism. A portion of the sucker rod on an upstream side of the wire coil head relative to the feed direction is supported using the first support during feeding the sucker rod. A portion of the sucker rod on a downstream side of the wire coil head relative to the feed direction is supported using the second support during feeding the sucker rod. A portion of the sucker rod within the heating zone is inductively heated using the induction heating device during feeding the sucker rod. Scale deposits on a surface of the inductively heated portion of the sucker rod are discharged from the surface in response to inductively heating the portion of the sucker rod.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

DETAILED DESCRIPTION OF ILLUSTRATIVE EMBODIMENTS

Figure 1:
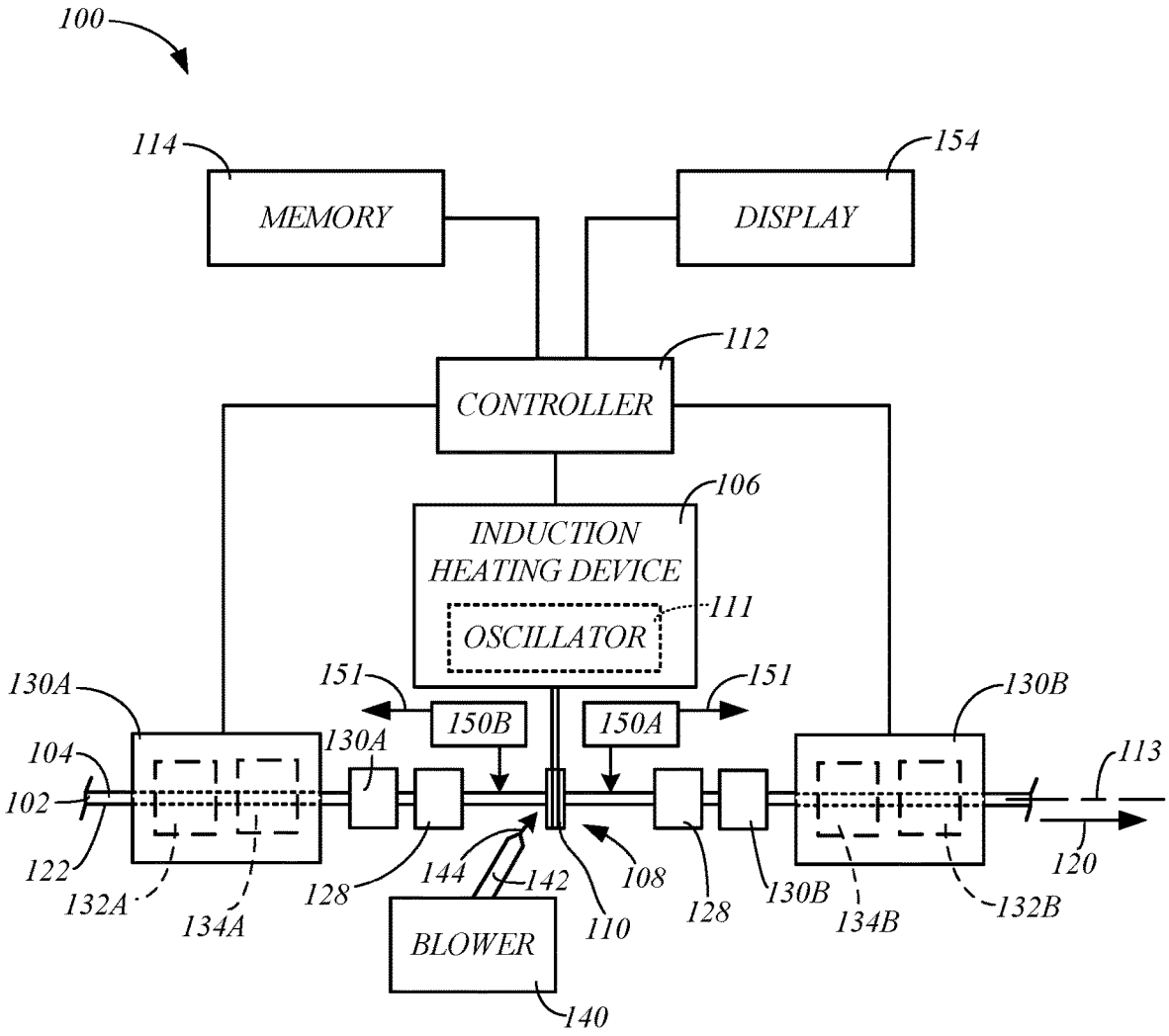
FIG. 1 is a simplified drawing of a sucker rod cleaning system that is configured to clean a sucker rod 102, in accordance with embodiments of the present disclosure.

Embodiments of the present disclosure are described more fully hereinafter with reference to the accompanying drawings. Elements that are identified using the same or similar reference characters refer to the same or similar elements. The various embodiments of the present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art.

Embodiments of the present disclosure include systems and methods for cleaning sucker rods used to join surface and downhole or borehole components of an oil or gas extraction system, such as components of a reciprocating piston pump, for example. FIG. 1 is a simplified drawing of a sucker rod cleaning system 100 that is configured to clean a sucker rod 102, in accordance with embodiments of the present disclosure. As mentioned above, sucker rods 102 are rigid rods that are used in the oil industry to join surface and downhole or borehole components together, such as components of a reciprocating piston pump, for example. The sucker rod 102 may be in accordance with conventional sucker rods, which are typically formed of iron or steel, have a diameter of approximately 0.75-1.375 inches, have threaded ends, and a length of approximately 25-30 feet.

Embodiments of the system 100 operate to clean the surface 104 of the sucker rod 102 through induction heating using an induction heating device 106. The induction heating device 106 may include conventional components for heating the surface 104 of the sucker rod 102 through electromagnetic induction. For example, the exemplary induction heating device 106 includes an electromagnet 108 formed by a wire coil head 110 (work head), and an electronic oscillator 111 that drives a high-frequency alternating current through the electromagnet 108. The alternating current passing through the electromagnet 108 produces a rapidly alternating magnetic field that penetrates the surface 104 of the sucker rod 102 and generates electric currents (eddy currents) within the sucker rod 102. These currents generate heat at the surface 104 of the sucker rod 102 due to the resistance of the material forming the sucker rod 102.

A suitable induction heating device that may be used as the device 106 may have a water-cooled solid-state induction power supply having a CE rated input of 440-520 VAC, 50/60 Hz; a 3-phase water-cooled output having a 111 kW terminal at 50-150 kHz. The wire head 110 may be water-cooled, formed of copper and include a voltage range of 440 to 520V. In some embodiments, the wire head 110 has an inside diameter of about 2.5-3.5 inches and a thickness, which is measured along an axis 113 that is substantially coaxial to the head 110, of 1-3 inches, such as approximately 2 inches.

The system 100 may also include a controller 112, which represents one or more processors that control components of the system 100 to perform one or more functions described herein in response to the execution of instructions, which may be stored locally in memory 114 of the system 100, or memory that is external to the device 110, for example. In some embodiments, the processors of the controller 112 are components of one or more computer-based systems. In some embodiments, the controller includes one or more control circuits, microprocessor-based engine control systems, one or more programmable hardware components, such as a field programmable gate array (FPGA), that are used to control components of the system 100 to perform one or more functions described herein.

The memory 114 may be any suitable patent subject matter eligible computer readable media or memory including, for example, hard disks, CD-ROMs, optical storage devices, or magnetic storage devices. Such computer readable media or memory do not include transitory waves or signals.

In some embodiments, the controller 112 controls the activation, deactivation, and other functions of the induction heating device 106. The controller 112 may also control the amplitude and frequency of the alternating current that is driven through the electromagnet 108, based on user settings or user input. In some embodiments, the AC voltage supplied to the electromagnet 108 is regulated by the controller 112 to prevent heating the rod 102 above 500° F., or to a temperature where plastic deformation may occur. In some embodiments, the frequency of the AC voltage supplied to the electromagnet 108 is about 600V-850V.

Figure 2:
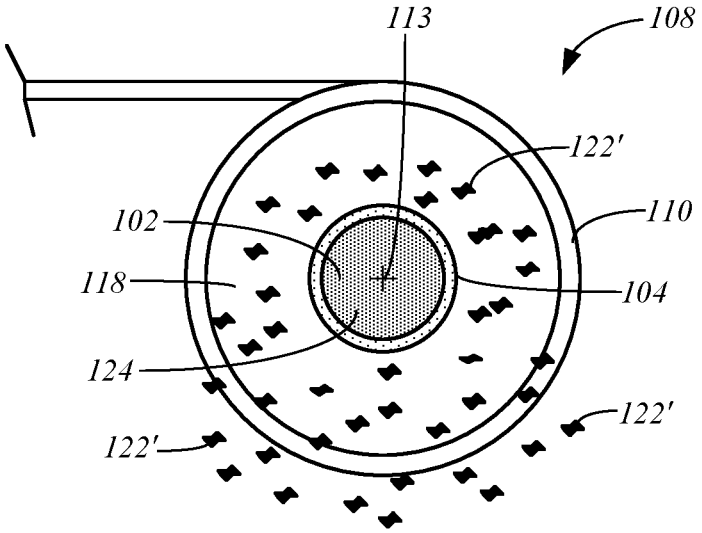
FIG. 2 is a simplified side cross-sectional view of a portion of the system of FIG. 1.

In some embodiments, the eddy currents generated within the sucker rod 102 by the heating device 106 are concentrated near the surface 104, such as within the lightly shaded area of the sucker rod illustrated in FIG. 2, which is a simplified side cross-sectional view of FIG. 1 taken at the electromagnet 108 of the induction heating device 106. In some embodiments, the induction heating of the sucker rod 102 penetrates the surface 104 approximately 0.1 inch.

Figure 3:
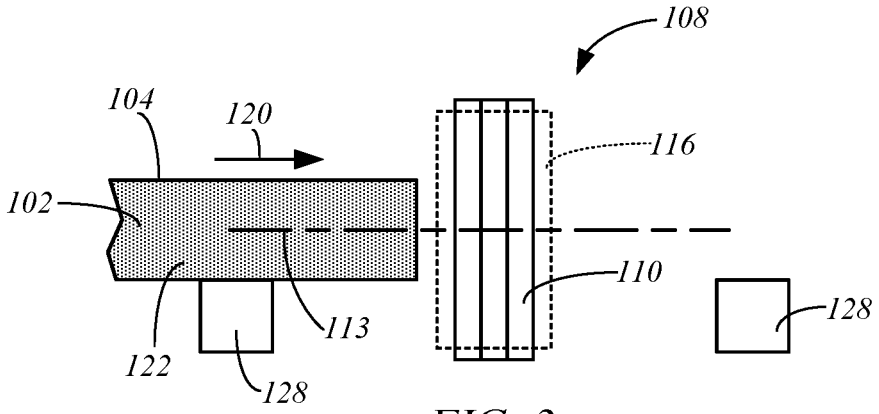
FIGS. 3 and 4 are simplified front views illustrating the feeding of the sucker rod through the wire coil of the electromagnet during a sucker rod surface cleaning operation, in accordance with embodiments of the present disclosure.
Figure 4:
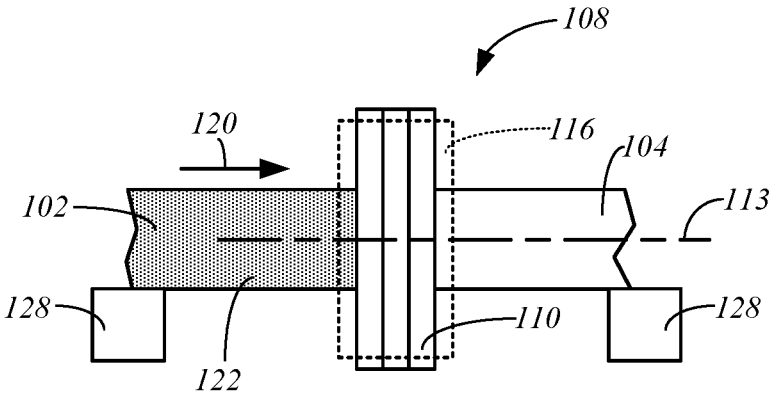

FIGS. 3 and 4 are simplified front views illustrating the feeding of the sucker rod 102 through the wire head 110 of the electromagnet 108 during a sucker rod surface cleaning operation, in accordance with embodiments of the present disclosure. When the controller 112 activates the induction heating device 106, an effective heating zone 116 is formed within the interior 118 of the wire head 110, This heating zone 116 may also extend slightly beyond the wire head 110 along a central axis 113 of the wire head 110, as shown in FIG. 3.

During a sucker rod cleaning operation, the sucker rod 102 may be fed along the axis 113 toward the electromagnet 108, as indicated by arrow 120 in FIG. 3. As the sucker rod 102 penetrates the heating zone 116, the entire surface 104 of the sucker rod 102 that is within the heating zone 116 is rapidly heated through induction heating. In some embodiments, the surface 104 is heated to a temperature of approximately 200° F.-400° F. This rapid heating of the surface 104 causes the scale 122 on the surface 104 to "pop off" the surface 104, such as due to the rapid vaporization of components of the scale 122, thermal expansion of the scale 122 relative to the surface 104, and/or other thermal-related, mechanisms. As a result, particles 122' of the scale 122 are shed from the surface 104 of the sucker rod 102 that is within the heating zone 116, as generally shown in FIG. 2. As a result, the surface 104 of the sucker rod 102 is generally free from the scale 122 after leaving the effective heating zone, as illustrated in FIG. 4.

The period of time that a portion of the surface 104 of the sucker rod 102 is within the heating zone 116 may be limited to prevent the central region 124 (dark shaded region in FIG. 2) of the sucker rod 102 from reaching a temperature at which plastic deformation may occur. Thus, some embodiments of the heating operation focus on heating the entirety of surface 104 of the sucker rod and are not used to raise the temperature of the sucker rod 102 to a temperature at which the sucker rod 102 is subject to plastic deformation, such as to reshape the sucker rod 102, for example. Furthermore, since only a small portion of the sucker rod 102 is heated at any given time, portions of the sucker rod 102 that have not passed through the heating zone 116 remain in a relatively cool state while the surface 104 of the portions of the sucker rod 102 that have passed through the heating zone 116 are rapidly cooled through the transfer of heat through the environment and to the central region 124 of the sucker rod 102. As a result, the induction heating performed during the sucker rod cleaning operation is generally not suitable for reshaping the sucker rod 102.

Figure 5:
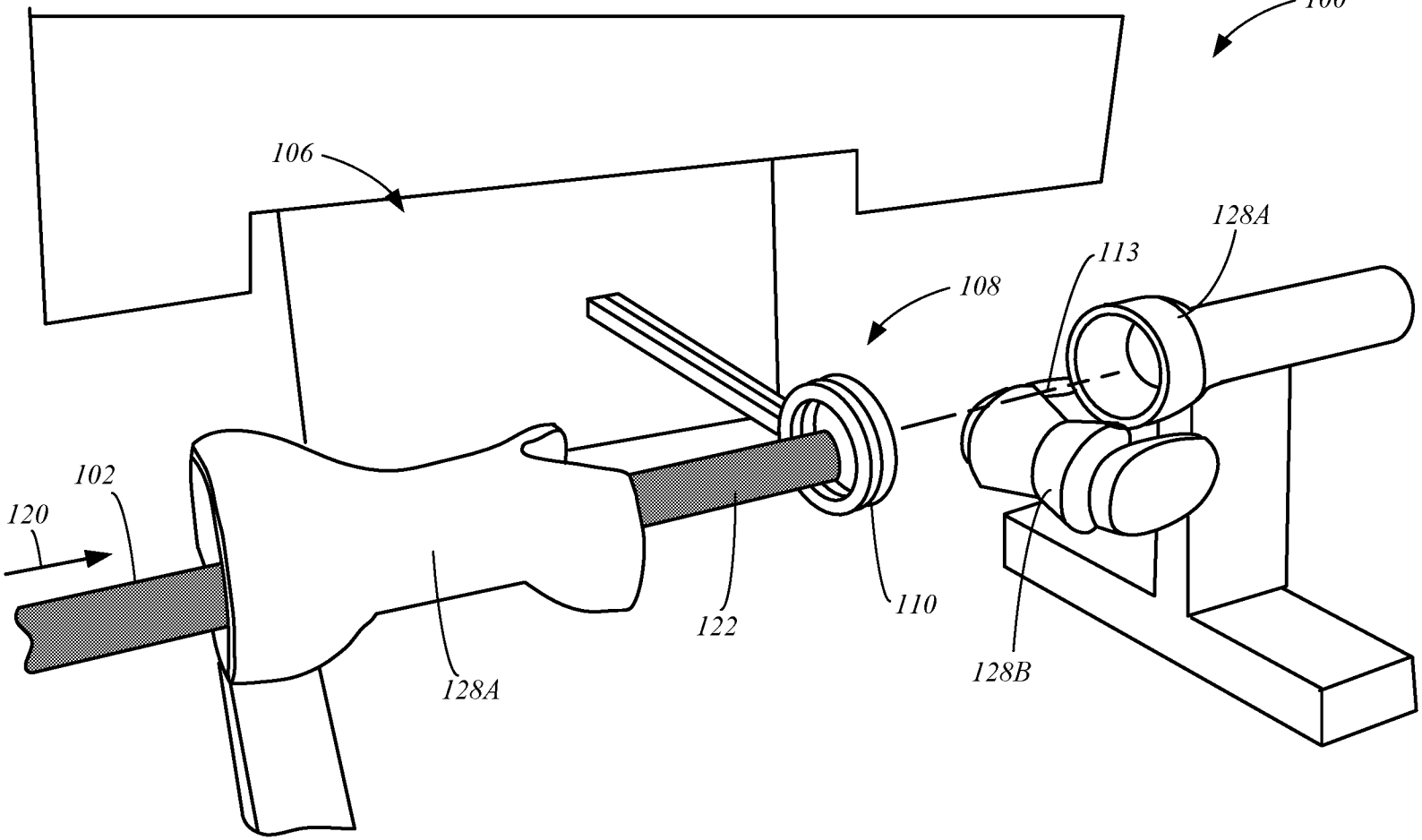
FIGS. 5 and 6 are simplified isometric views of portions of the sucker rod cleaning system, in accordance with embodiments of the present disclosure.
Figure 6:
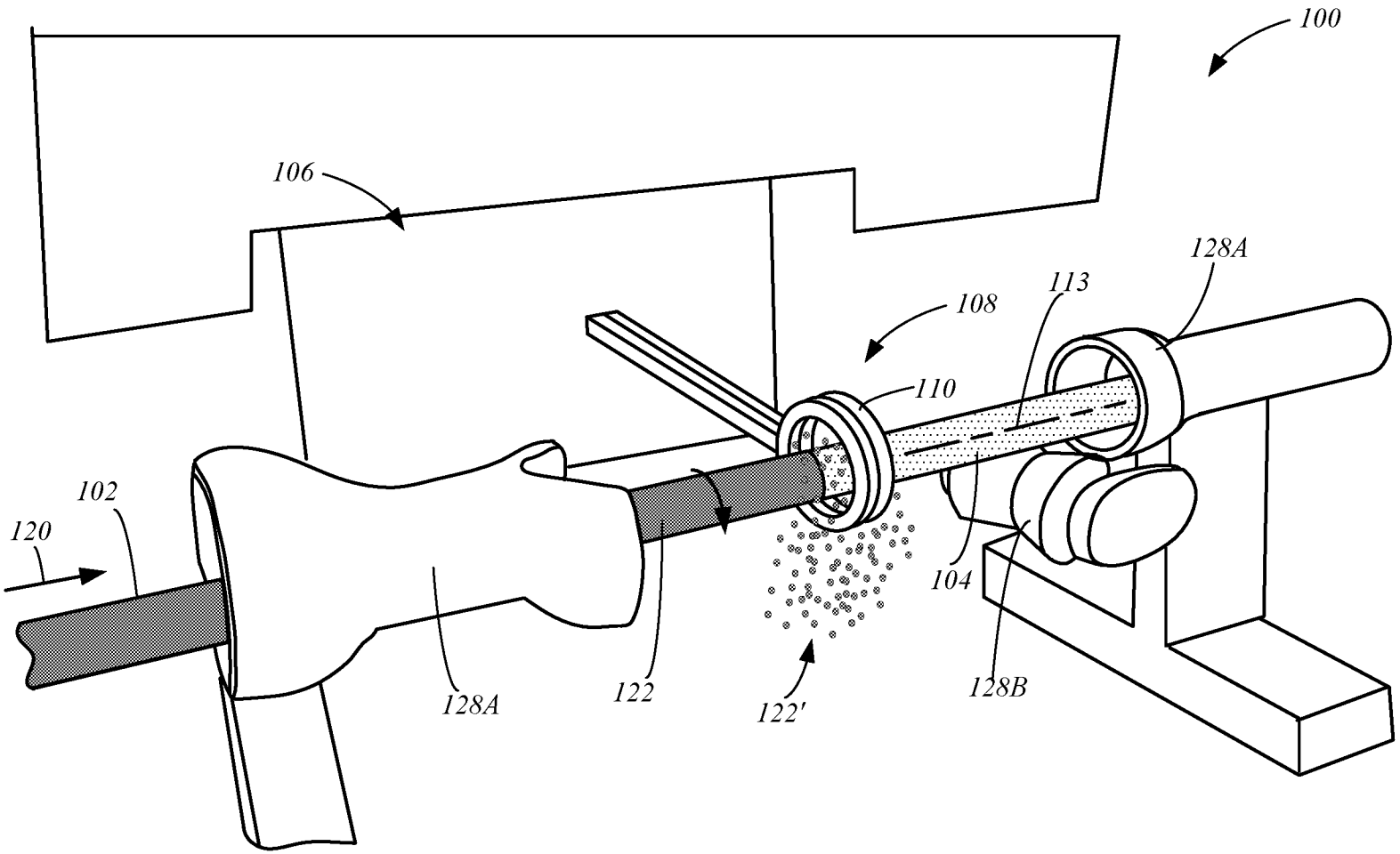

FIGS. 5 and 6 are simplified isometric views of portions of the sucker rod cleaning system 100 in accordance with embodiments of the present disclosure. In some embodiments, the system 100 includes one or more sucker rod supports 128 that operate to support the sucker rod 102 during a cleaning operation. In some embodiments, the system 100 includes one or more supports 128 on an upstream side of the wire coil head 110 relative to the feed direction 120, and one or more supports 128 on a downstream side of the wire coil head 110 of the electromagnet 108 relative to the feed direction 120, as indicated in FIG. 1. The supports 128 may include tubular support members 128A, through which the sucker rod 102 is fed, and/or roller support members 128B (e.g., V-grove rollers), on which the sucker rod may be supported, as shown in FIGS. 5 and 6, and/or other supports for the sucker rod 102 being cleaned by the system 100.

The system 100 may also include one or more feed mechanisms 130 that are configured to feed the sucker rod 102 along the axis 113 in the feed direction 120, and possibly in the reverse of the feed direction 120. In some embodiments, the system 100 includes a feed mechanism 130A positioned on the upstream side of the electromagnet 108 relative to the feed direction 120, and/or a feed mechanism 130B positioned on the downstream side of the electromagnet 108 relative to the feed direction 120, as shown in FIG. 1. The feed mechanisms 130 may take on any suitable form. In some embodiments, the feed mechanisms 130 include a motorized roller that drives the sucker rod along the axis 113.

The system 100 may also include one or more rotators 132 that are configured to rotate the sucker rod 102 about the axis 113, such as while the sucker rod 102 is fed along the axis 113, for example. As shown in FIG. 1, the system 100 may include a rotator 132A positioned on the upstream side of the electromagnet 108 relative to the feed direction 120, and/or a rotator 132B positioned on the downstream side of the electromagnet 108 relative to the feed direction 120. In some embodiments, the rotator 132 is combined with the corresponding feed mechanism 130 to simultaneously drive the sucker rod 102 along the axis 113 and rotate the sucker rod 102 generally about the axis 113.

The rotation of the sucker rod 102 is not generally used to cause even heating of the surface 104 of the sucker rod 102, since that is generally provided by the feeding of the sucker rod 102 through the heating zone 116. Rather, the rotation of the sucker rod 102 about the axis 113 assists in flinging scale debris 122' from the surface 104 during the cleaning operation. In some embodiments, the sucker rod 102 is rotated by the one or more rotators 132 at a rate of approximately 50-100 revolutions per minute, such as 75 revolutions per minute.

Some embodiments of the sucker rod cleaning system 100 include one or more vibration mechanisms 134, which are configured to induce a vibration in the sucker rod 102 during the sucker rod cleaning operation, such as while the sucker rod 102 is fed along the axis 113, to increase the efficiency at which the scale 122 is removed from the surface 104 of the sucker rod 102. The system 100 may include a vibration mechanism 134A that is positioned on the upstream side of the electromagnet 108 relative to the feed direction 120, and/or a vibration mechanism 134B positioned on the downstream side of the electromagnet 108 relative to the feed direction 120, as shown in FIG. 1. The vibration mechanisms 134 may take on any suitable form while inducing the desired vibration in the sucker rod 102. In some embodiments, the vibration mechanism is combined with the rotation mechanism 132 to induce a vibration in the sucker rod 102 by rotating the sucker rod 102 about an axis that is non-coaxial to the central axis of the sucker rod 102. In another example, the vibration mechanism 134 may induce the vibration to the feed mechanism 130, the support 128, or other components of the system 100, which is then transferred to the sucker rod 102 during the cleaning operation.

In some embodiments, the system 100 includes a blower 140 having a nozzle 142 that is configured to discharge an air stream 144 at the heating zone 116, such as at the portion of the surface 104 of the sucker rod 102 that is within the heating zone 116. The air stream 144 enhances the removal of the scale 122 from the surface 104. Additionally, when the system 100 includes one or more rotators 132, the air stream 144 can be applied to the entire surface 104 during the course of a revolution of the rod 102 to enhance the removal of the scale 122.

In some embodiments, the sucker rod cleaning system 100 includes one or more sensors 150, each sensor 150 being configured to detect a condition of the surface 104 of the sucker rod 102 and produce a sensor output 151 indicative of the detected condition. In some embodiments, the sensors 150 include at least one sensor 150A that is positioned on a downstream side of the electromagnet 108 relative to the feed direction 120. The sensor 150A may include an optical sensor that detects the reflectance of the surface 104 after passing through the wire head 110, For example, the optical sensor 150A may include an emitter that transmits electromagnetic energy toward the surface 104, and a receiver that detects the electromagnetic energy that has been reflected from the surface 104. The intensity of the reflected electromagnetic energy may represent the presence and/or the absence of the scale 122 from the surface 104. For example, the detection of a relatively low magnitude of the reflected electromagnetic energy may represent the presence of the scale 122 on the surface 104, while a relatively high magnitude of the reflected magnetic energy may represent a clean surface 104. Thus, the optical sensor 150A may be used to estimate the cleanliness of the surface 104 after the performance of the induction heating operation.

In some embodiments, the downstream sensor 150A includes a displacement sensor that is configured to detect a position of the surface 104 of the sucker rod to estimate the cleanliness of the surface 104. For example, the position indicated by the sensor 150A may be compared to a reference for a clean surface 104. When the detected position of the surface 104 is different from the reference, the controller 112 may determine that scale 122 remains on the surface 104. However, when the detected position of the surface 104 substantially matches the reference, the controller 112 can determine that the scale 122 was successfully removed from the surface 104.

In some embodiments, the sensors 150 include at least one sensor 150B that is positioned on the upstream side of the electromagnet 108 relative to the feed direction 120, and is used to detect a pre-cleaning condition of the surface 104. The sensor 150B may include an optical sensor for detecting a reflectance of the surface 104 that is indicative of the scale 122 on the surface 104. The detected reflectance of the surface 104 may be compared to the reflectance detected by the sensor 150A to determine the cleanliness of the surface 104.

The sensor 150B may include a displacement sensor that is configured to detect a thickness of the scale 122 on the sucker rod 102 based upon a known or estimated position of the surface 104 beneath the scale 122. The detected thickness or position of the scale 122 on the surface 104 may be used as the reference that is compared to the position of the surface 104 detected by the sensor 150A to determine the cleanliness of the surface 104 or the amount of scale 122 that was removed during the cleaning operation.

In some embodiments, the sensor 150A includes a radiation sensor having a sensor output that is indicative of a level of radiation being discharged from the sucker rod 102, such as the portion of the sucker rod 102 that has gone through the induction heat-cleaning process and is downstream from the heating zone 116. Any suitable radiation sensor may be used, such as a Geiger-Muller counter, which detects ionizing radiation discharged from the scale 122. The controller 112 uses the radiation sensor 150A, to detect a radiation level of portions of the sucker rod 102 during the cleaning operation. If the detected radiation level of a portion of the sucker rod 102 is equal to or less than a threshold radiation level, such as a background radiation level, the controller 112 determines that the portion of the sucker rod 102 has been successfully cleaned or decontaminated. If the detected radiation level of a portion of the sucker rod 102 is greater than the threshold radiation level, then the controller 112 determines that the sucker rod portion has not been successfully cleaned and remains contaminated by the scale 122.

If the controller 112 determines that the cleaning operation performed on the sucker rod 102 successfully removed the scale 122 from the surface 104, such as using the one or more sensors 150, a notification may be provided to a user of the system 100, such as on a display 154 (FIG. 1). If the controller 112, based on the one or more sensors 150, determines that the cleaning operation did not completely remove the scale 122 from the surface 104, the controller 122 may reverse the feeding of the sucker rod 102 and re-feed a portion of the sucker rod 102 that was not successfully cleaned back through the electromagnet 108 one or more times until the one or more sensors 150 indicate that the scale 122 has been satisfactorily removed from the surface 104. Additionally, the controller 112 may issue a notification on the display 154 indicating the results of the cleaning operation.

The controller 112 may adjust the rate at which the sucker rod 102 is fed along the axis 113 in response to the condition of the surface 104 detected by the one or more sensors 150. For example, when the one or more sensors 150 detect that, after passing through the heating zone 116, the scale 122 has not been removed from a portion of the surface 104, the controller 112 may decrease the speed at which the sucker rod 102 is fed along the axis 113 by the one or more feed mechanisms 130, increase the amplitude of the alternating current driven through the wire head 110 to increase the heating of the sucker rod 102, increase the vibration induced by the one or more vibration mechanisms 134, increase the flowrate of the air stream 144 generated by the blower 140, and/or perform another adjustment to improve the cleaning of the scale 122 from the sucker rod 102.

In some embodiments, the at least one sensor 150A includes a temperature sensor that is configured to detect the temperature of the surface 104 of the sucker rod 102. The detected temperature may be used to detect the cleanliness of the surface 104, or used as feedback to the controller 112 to control the temperature to which the surface 104 of the sucker rod 102 is heated by the electromagnet 108. For example, when the temperature detected by the temperature sensor 150A indicates that the temperature of the surface 104 is below a desired temperature, the current supplied to the electromagnet 108 may be increased, and/or the speed at which the sucker rod 102 is fed along the axis 113 may be slowed, to increase the heating of the surface 104 as it passes through the electromagnet 108. Likewise, when the temperature detected by the temperature sensor 150A exceeds the desired temperature, the current supplied to the electromagnet 108 may be decreased, and/or the speed at which the sucker rod 102 is fed along the axis 113 may be increased, to decrease the heating of the surface 104 as it passes through the electromagnet 108.

Figure 7:
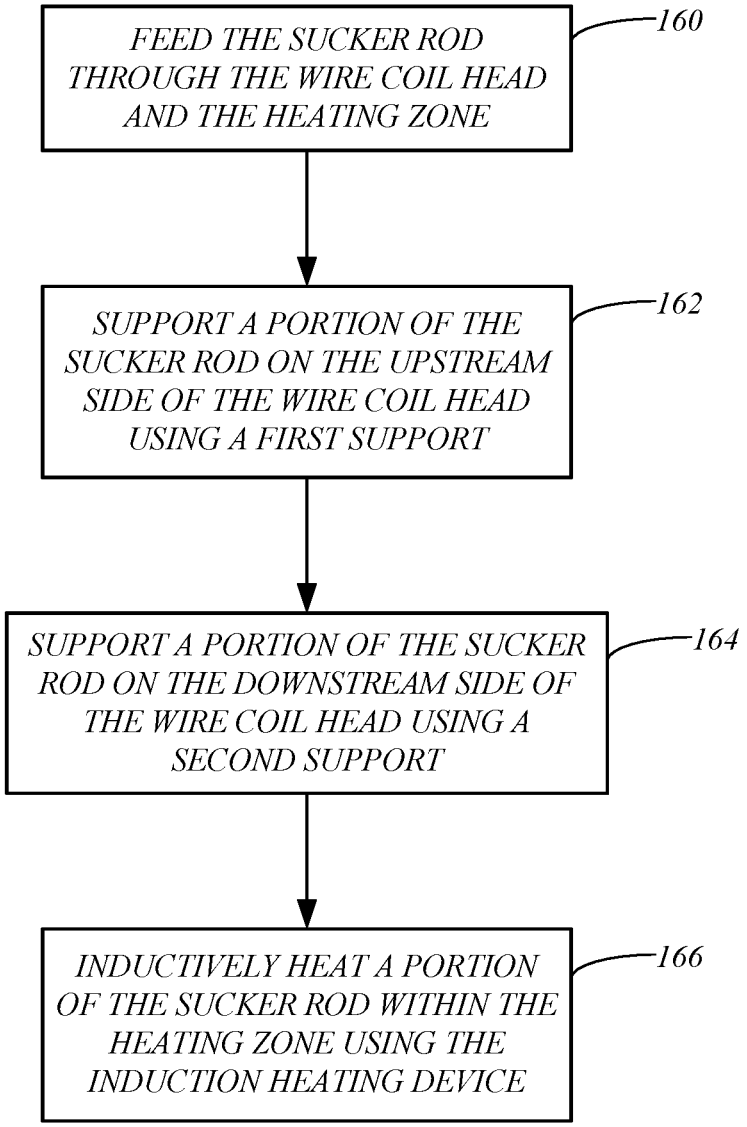
FIG. 7 is a flowchart illustrating a method of cleaning a sucker rod using the sucker rod cleaning system, in accordance with embodiments of the present disclosure.

FIG. 7 is a flowchart illustrating a method of cleaning a sucker rod using the system 100, in accordance with embodiments of the present disclosure. At 160 of the method, the sucker rod 102 is fed in the feed direction 120 along the axis 113 through the wire coil head 110 and the heating zone 116. At times during this feeding of the sucker rod. 102, portions of the sucker rod 102 on the upstream side of the wire coil head 110 relative to the feed direction 120 may be supported by a first support 128, as indicated at step 162, and portions of the sucker rod 102 on the downstream side of the wire coil head 110 relative to the feed direction may be supported by a second support 128, as indicated at step 164, and shown in FIGS. 1 and 3-6. As discussed above, the supports 128 may include a tubular support 128A and/or roller support 128B, as shown in FIGS. 5 and 6.

At 166, the portion of the sucker rod 102 that is within the heating zone 116 is inductively heated using the induction heating device 106, as discussed above. This heating causes the scale deposits 122 on the surface 104 of the inductively heated portion of the sucker rod 102 to be discharged or expelled (e.g., "pop off") from the surface 104 (FIGS. 2 and 6) as particles or pieces 122', as discussed above to clean the sucker rod 102.

The sticker rod cleaning operation in accordance with one or more embodiments of the present disclosure provides advantages over conventional sucker rod cleaning operations. For example, the cleaning operation performed in accordance with embodiments of the present disclosure avoids the use of chemicals that may be harmful to the environment and the workers performing the cleaning operation. Additionally, the scale debris 122' is generally discharged from the heated rod surface 104 in relatively large particles or pieces that are easy to collect and dispose of, as opposed to the fine dust that may be generated by sucker rod cleaning operations that involve scraping the sucker rod. Additional advantages may also be provided by embodiments of the sucker rod cleaning operation.

Although the embodiments of the present disclosure have been described with reference to preferred embodiments, workers skilled in the art will recognize that changes may be made in form and detail without departing from the spirit and scope of the present disclosure.

What is claimed is:

1. A sucker rod cleaning system comprising:

an induction heating device including an electromagnet comprising a wire coil head configured to inductively heat an electrically conductive sucker rod positioned within a heating zone of the wire coil head;

a sucker rod feed mechanism configured to feed a sucker rod through the heating zone of the wire coil head in a feed direction; and a radiation sensor positioned on a downstream side of the inductive heating device relative to the feed direction and configured to generate a sensor output that is indicative of a level of ionizing radiation being discharged from the sucker rod.

2. The system of claim 1, further comprising a controller configured to adjust the feeding of the sucker rod through the heating zone of the wire coil head by the feed mechanism based on the sensor output.

3. The system of claim 2, wherein the controller adjusts a speed at which the sucker rod is fed through the heating zone of the wire coil head based on the sensor output.

4. The system of claim 3, wherein the controller compares the level of ionizing radiation indicated by the sensor output to a threshold value and adjusts the feeding of the sucker rod based on the comparison.

5. The system of claim 1, further comprising a controller configured to adjust the inductive heating of the sucker rod by the heating device based on the sensor output.

6. The system of claim 1, wherein the controller compares the level of ionizing radiation indicated by the sensor output to a threshold value and adjusts the inductive heating of the sucker rod by the heating device based on the comparison.

7. The system of claim 1, wherein the induction heating device includes an electronic oscillator configured to drive a high-frequency alternating current through the wire coil head of the electromagnet.

8. The system of claim 1, further comprising a rotator configured to rotate a sucker rod as the sucker rod is fed through the heating zone of the wire coil head by the feed mechanism.

9. The system of claim 1, further comprising a vibrator configured to vibrate a sucker rod as it is fed through the heating zone of the wire coil head by the feed mechanism.

10. The system of claim 1, wherein the feed mechanism includes a portion on the upstream side of the wire coil head configured to feed the sucker rod in the feed direction.

11. The system of claim 1, wherein the feed mechanism includes a portion on the downstream side of the wire coil head configured to feed the sucker rod in the feed direction.

12. The system of claim 1, further comprising a blower including a nozzle configured to discharge an air stream at an exterior surface of the portion of the sucker rod that is within the heating zone during inductive heating of the portion.

13. A method of cleaning scale deposits from an exterior surface of a used sucker rod using a sucker rod cleaning system, which comprises an induction heating device including an electromagnet comprising a wire coil head having a heating zone, a sucker rod feed mechanism, and a radiation sensor, the method comprising:

feeding the used sucker rod in a feed direction through the wire coil head and the heating zone using the sucker rod feed mechanism;

inductively heating a portion of the used sucker rod within the heating zone using the induction heating device during feeding the sucker rod;

discharging the scale deposits from the exterior surface of the portion of the used sucker rod during inductively heating the portion; and generating a sensor output using the radiation sensor that is indicative of a level of ionizing radiation being discharged from the used sucker rod at a location that is on a downstream side of the inductive heating device relative to the feed direction.

14. The method of claim 13, further comprising controlling the feeding of the used sucker rod by the feed mechanism based on the sensor output using a controller of the system.

15. The method of claim 14, wherein:

the method comprises comparing the level of ionizing radiation indicated by the sensor output to a threshold value using the controller; and controlling the feeding of the used sucker rod comprises controlling the feeding of the sucker rod by the feed mechanism based on the comparison.

16. The method of claim 13, further comprising adjusting the inductive heating of the used sucker rod by the heating device based on the sensor output using a controller of the system.

17. The method of claim 16, wherein:

the method comprises comparing the level of ionizing radiation indicated by the sensor output to a threshold value using the controller; and adjusting the heating of the used sucker rod comprises adjusting the heating of the used sucker rod by the heating device based on the comparison.

18. The method of claim 13, further comprising one of rotating the used sucker rod during feeding the used sucker rod using a rotator of the system and vibrating the used sucker rod during feeding the used sucker rod using a vibrator of the system.

19. The method of claim 13, further comprising:

discharging an air stream at the portion of the used sucker rod during inductively heating the portion using a blower of the system; and blowing scale particles off the portion of the used sucker rod using the airstream.

20. A method of cleaning scale deposits from an exterior surface of a used sucker rod using a sucker rod cleaning system, which comprises an induction heating device including an electromagnet comprising a wire coil head having a heating zone, a sucker rod feed mechanism, a radiation sensor and a controller, the method comprising:

feeding the used sucker rod in a feed direction through the wire coil head and the heating zone using the sucker rod feed mechanism;

inductively heating a portion of the used sucker rod within the heating zone using the induction heating device during feeding the sucker rod;

discharging the scale deposits from the exterior surface of the portion of the used sucker rod during inductively heating the portion;

generating a sensor output using the radiation sensor that is indicative of a level of ionizing radiation being discharged from the used sucker rod at a location that is on a downstream side of the inductive heating device relative to the feed direction; and controlling one of feeding the used sucker rod and inductively heating the used sucker rod based on the sensor output using the controller.

* * * * *